US009576761B2

(12) United States Patent
Barbera et al.

(10) Patent No.: US 9,576,761 B2
(45) Date of Patent: Feb. 21, 2017

(54) CIRCUIT BREAKER CROSSBAR ASSEMBLY

(71) Applicant: General Electric Company, Schenectady, NY (US)

(72) Inventors: Christie Marie Barbera, Middlebury, CT (US); Shawn Couceiro Fonseca, Newington, CT (US); Linda Yvonne Jacobs, Barkhamstad, CT (US); Dhirendra Kumar Tiwari, Farmington, CT (US); Nagesh Venkata Tumu, Farmington, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 83 days.

(21) Appl. No.: 14/717,250

(22) Filed: May 20, 2015

(65) Prior Publication Data

US 2016/0343528 A1 Nov. 24, 2016

(51) Int. Cl.
*H01H 71/02* (2006.01)
*H01H 71/10* (2006.01)

(52) U.S. Cl.
CPC ..... *H01H 71/0207* (2013.01); *H01H 71/10* (2013.01); *H01H 2205/002* (2013.01)

(58) Field of Classification Search
CPC ..... H01H 71/0207; H01H 71/10; H01H 3/08; H01H 9/00
USPC ..... 200/238, 336; 337/50
See application file for complete search history.

(56) References Cited

U.S. PATENT DOCUMENTS

| | | | | |
|---|---|---|---|---|
| 3,341,791 | A | 9/1967 | Leonard | |
| 4,733,211 | A | 3/1988 | Castonguay | |
| 4,736,174 | A | 4/1988 | Castonguay | |
| 4,782,583 | A | 11/1988 | Castonguay | |
| 5,502,428 | A * | 3/1996 | McColloch | H01H 77/102 335/16 |
| 5,726,614 | A | 3/1998 | Castonguay | |
| 6,791,440 | B2 | 9/2004 | Harmon | |
| 6,965,292 | B2 | 11/2005 | Ciarcia | |
| 2009/0107819 | A1 | 4/2009 | Samudrikam | |
| 2013/0075238 | A1 * | 3/2013 | Fischer-Carne | H01H 9/52 200/279 |

* cited by examiner

*Primary Examiner* — Edwin A. Leon
*Assistant Examiner* — Iman Malakooti
(74) *Attorney, Agent, or Firm* — GE Global Patent Operation; Stephen G. Midgley

(57) ABSTRACT

A circuit breaker crossbar assembly includes a crossbar having a first and second segment, the first and second segment each operatively coupled to a respective moveable contact arm assembly. Also included is a coupling segment disposed between the first and second segment, the crossbar and the coupling segment rotatable about an axis. Further included is at least one support assembly operatively coupled to the coupling segment. The support assembly includes a bushing coupled to the coupling segment and rotatable with the crossbar and the coupling segment. The support assembly also includes a support bracket configured for affixation to a stationary structure and disposed adjacent to the bushing, the bushing rotatable relative to the support bracket. The support assembly further includes a fixing bracket engaged with the support bracket and disposed adjacent to the bushing, the bushing rotatable relative to the fixing bracket.

20 Claims, 6 Drawing Sheets

CIRCUIT BREAKER CROSSBAR ASSEMBLY

BACKGROUND OF THE DISCLOSURE

The subject matter disclosed herein relates to circuit breakers and, more particularly, to a support assembly for a crossbar assembly of a circuit breaker.

Circuit breakers are used to protect equipment from overcurrent situations caused, for example, by short circuits or ground faults in or near such equipment. A circuit breaker may be manually switched from an "ON" condition to an "OFF" condition and vice versa. Additionally, the circuit breaker includes a mechanism that is configured to automatically switch the circuit breaker to an "OFF" (e.g., "TRIP") condition in response to an undesirable operating situation, such as a short circuit, for example. Various components are employed to convert the manual input or the automatic initiation of condition switching to rotation of moveable contact arm assemblies that determine a condition of the circuit breaker. One component that may rotate the moveable contact arm assemblies is a crossbar operatively coupled to the moveable contact arm assemblies.

Some crossbar assemblies are formed of multiple segments that are joined together with the entire assembly simply coupled at ends to brackets or the like, thereby leaving little to no support along intermediate locations of the crossbar assembly. Therefore, the crossbar assembly is prone to bending during rotation, which may lead to wear of the components at a rate that is less than desirable.

BRIEF DESCRIPTION OF THE DISCLOSURE

According to one aspect of the disclosure, a circuit breaker crossbar assembly includes a crossbar having a first segment and a second segment, the first segment and the second segment each operatively coupled to a respective moveable contact arm assembly. Also included is a coupling segment disposed between the first segment and the second segment, the crossbar and the coupling segment rotatable about an axis. Further included is at least one support assembly operatively coupled to the coupling segment. The support assembly includes a bushing coupled to the coupling segment and rotatable with the crossbar and the coupling segment. The support assembly also includes a support bracket configured for affixation to a stationary structure and disposed adjacent to the bushing, the bushing rotatable relative to the support bracket. The support assembly further includes a fixing bracket engaged with the support bracket and disposed adjacent to the bushing, the bushing rotatable relative to the fixing bracket, the support bracket and the fixing bracket together at least partially surrounding the bushing.

According to another aspect of the disclosure, a circuit breaker crossbar assembly includes a crossbar having a first segment, a second segment and a third segment, each segment operatively coupled to a respective moveable contact arm assembly. Also included is a first coupling segment disposed between the first segment and the second segment. Further included is a second coupling segment disposed between the second segment and the third segment, the crossbar, the first coupling segment and the second coupling segment rotatable about an axis. Yet further included is a first support assembly operatively coupled to the first coupling segment. The first support assembly includes a first bushing coupled to the first coupling segment, the first bushing having a protrusion extending therefrom into a first coupling segment recess, the first bushing including a first circumferentially extending groove. The first support assembly also includes a first support bracket configured for affixation to a stationary structure and disposed in the first circumferentially extending groove of the first bushing to be disposed adjacent to the first bushing, the first bushing rotatable relative to the first support bracket. The first support assembly further includes a first fixing bracket engaged with the first support bracket and disposed in the first circumferentially extending groove to be disposed adjacent to the first bushing, the first bushing rotatable relative to the first fixing bracket, the first support bracket and the first fixing bracket together at least partially surrounding the first bushing. The crossbar assembly also includes a second support assembly operatively coupled to the second coupling segment. The second support assembly includes a second bushing coupled to the second coupling segment, the second bushing having a protrusion extending therefrom into a second coupling segment recess, the second bushing including a second circumferentially extending groove. The second support assembly also includes a second support bracket configured for affixation to the stationary structure and disposed in the second circumferentially extending groove of the second bushing to be disposed adjacent to the second bushing, the second bushing rotatable relative to the second support bracket. The second support assembly further includes a second fixing bracket engaged with the second support bracket and disposed in the second circumferentially extending groove to be disposed adjacent to the second bushing, the second bushing rotatable relative to the second fixing bracket, the second support bracket and the second fixing bracket together at least partially surrounding the second bushing.

According to yet another aspect of the disclosure, a circuit breaker includes at least one moveable contact arm assembly configured to conduct current through the circuit breaker. Also included is a mechanism configured to actuate movement of the at least one moveable contact arm assembly. Further included is a crossbar having at least one segment, the crossbar rotatable between a first rotational position and a second rotational position and operatively coupled to the mechanism and to the at least one moveable contact arm assembly to rotate the at least one moveable contact arm assembly. Yet further included is a coupling segment disposed adjacent to the at least one segment, the crossbar and the coupling segment rotatable about an axis. Also included is at least one support assembly operatively coupled to the coupling segment. The support assembly includes a bushing coupled to the coupling segment and rotatable with the crossbar and the coupling segment. The support assembly also includes a support bracket configured for affixation to a stationary structure and disposed adjacent to the bushing, the bushing rotatable relative to the support bracket. The support assembly further includes a fixing bracket engaged with the support bracket and disposed adjacent to the bushing, the bushing rotatable relative to the fixing bracket, the support bracket and the fixing bracket together at least partially surrounding the bushing.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

Figure 1:
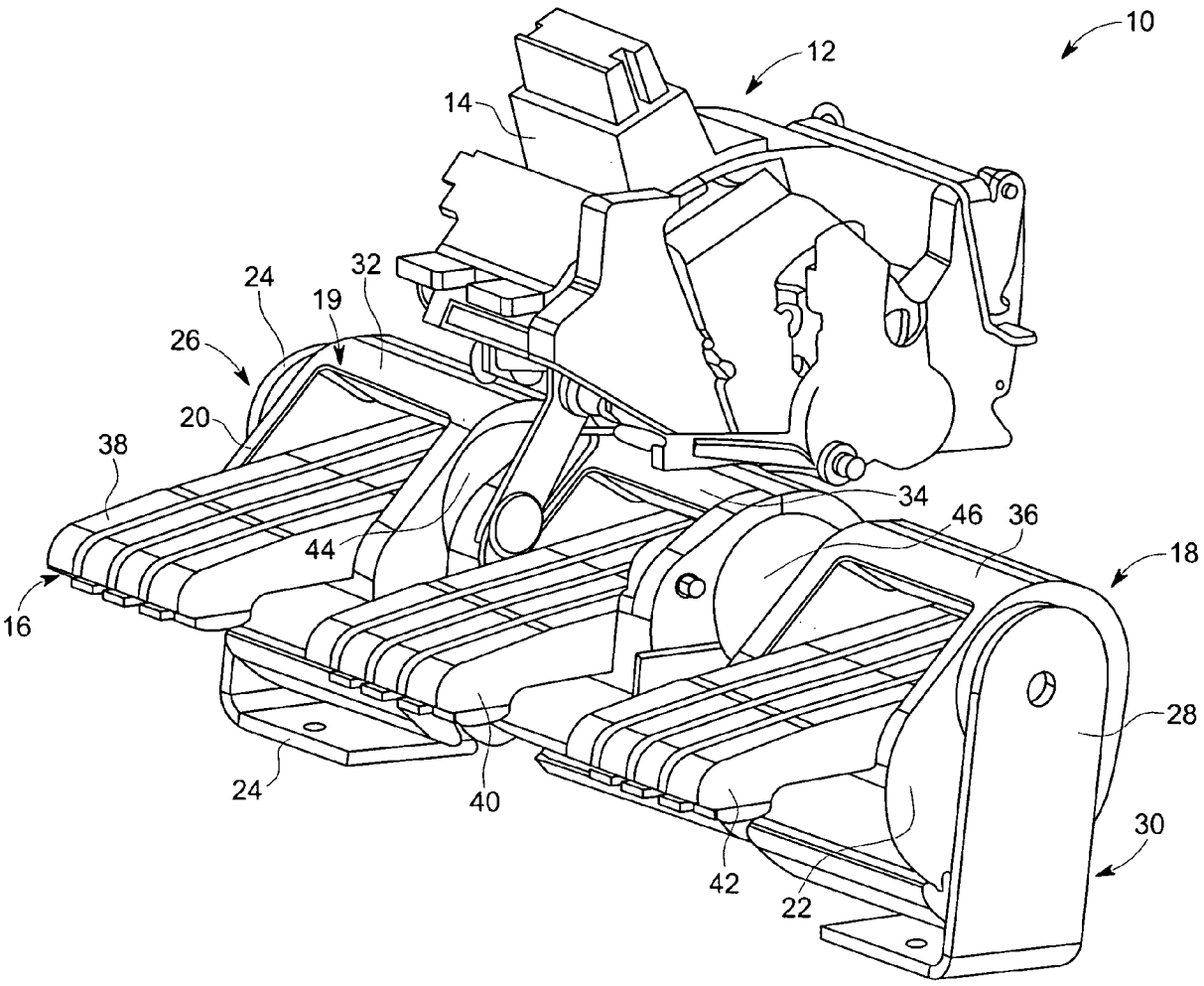
FIG. 1 is a perspective view of a mechanism assembly and a crossbar assembly of a circuit breaker.

Referring to FIG. 1, a circuit breaker 10 of the multi-pole variety is partially illustrated. The circuit breaker 10 has a cover and housing removed to better illustrate various components of the circuit breaker 10 that are relevant to the embodiments of the disclosure described herein. The circuit breaker 10 includes a mechanism 12 that is generally referenced with numeral 12. The mechanism 12 includes a number of components configured to detect a hazardous or undesirable operating condition and to initiate switching the circuit breaker 12 to a tripped or closed condition. Additionally, manual manipulation of the condition of the circuit breaker 10 is facilitated with a handle 14 that may be actuated by an operator. This gives the operator the ability to turn the circuit breaker 10 "ON" to energize a protected circuit, turn the circuit breaker "OFF" to disconnect the protected circuit breaker, or reset the circuit breaker after a fault. Overall, the mechanism 12 converts movement of the handle 14 into mechanical force to operate the circuit breaker 10.

The circuit breaker 10 illustrated depicts a three-phase configuration, however, the embodiments disclosed herein are not limited to this configuration, such that alternative phase configurations (e.g., one-phase, two-phase, four-phase, etc.) may be employed. Specifically, three moveable contact arm assemblies 16 are illustrated. The moveable contact arm assemblies 16 are rotating conductors that are disposed, at least partially, within a crossbar assembly 18 that includes a crossbar 19. The crossbar extends from a first end 20 to a second end 22. The first end 20 of the crossbar 19 is operatively coupled to a first bracket 24 located on a first side 26 of the circuit breaker 10. Similarly, the second end 22 of the crossbar 19 is operatively coupled to a second bracket 28 located on a second side 30 of the circuit breaker 10. The first end 20 and the second end 22 are rotatably coupled to the respective brackets 24, 28. The coupling may be made with any suitable coupling that allows rotation of the crossbar 19, such as with pin joint connections.

In operation, the crossbar 19 rotates upon actuation from the mechanism 12 to either drive the moveable contact arm assemblies 16 into a position that either renders the circuit breaker in the "ON" condition, the "OFF" condition, or the "TRIP" condition. Specifically, in the event an operator manually turns the circuit breaker 10 on, the mechanism 12 interacts with the crossbar 19, which drives the moveable contact arm assemblies 16 into a closed position. In the event an operator manually turns the circuit breaker 10 off, or if the mechanism automatically initiates a tripping sequence, the mechanism 12 interacts with the crossbar 19, which pulls the moveable contact arm assemblies into an open position.

The crossbar 19 includes multiple segments that are operatively coupled to the moveable contact arm assemblies 16. In the illustrated embodiment with three moveable contact arm assemblies, a first segment 32, a second segment 34 and a third segment 36 are included to correspond to the number of moveable contact arm assemblies. In such an embodiment, the first segment 32 is associated with a first moveable contact arm assembly 38, a second moveable contact arm assembly 40 and a third moveable contact arm assembly 42. Disposed between each pair of segments is at least one coupling segment of the crossbar 19. In the illustrated embodiment, a first coupling segment 44 is disposed between the first segment 32 and the second segment 34 of the crossbar 19, and therefore between the first moveable contact arm assembly 38 and the second moveable contact arm assembly 40. Similarly, a second coupling segment 46 is disposed between the second segment 34 and the third segment 36 of the crossbar 19, and therefore between the second moveable contact arm assembly 40 and the third moveable contact arm assembly 42. As noted above, the number of segments and moveable contact arm assemblies may vary depending upon the particular circuit breaker and as a result it is to be appreciated that the number of coupling segments may vary as well.

Figure 2:
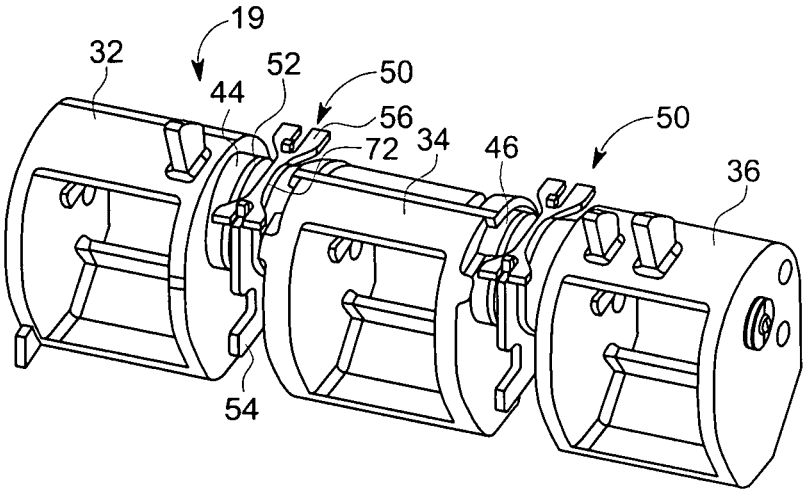
FIG. 2 is a perspective disassembled view of a crossbar operatively coupled to at least one support assembly.
Figure 3:
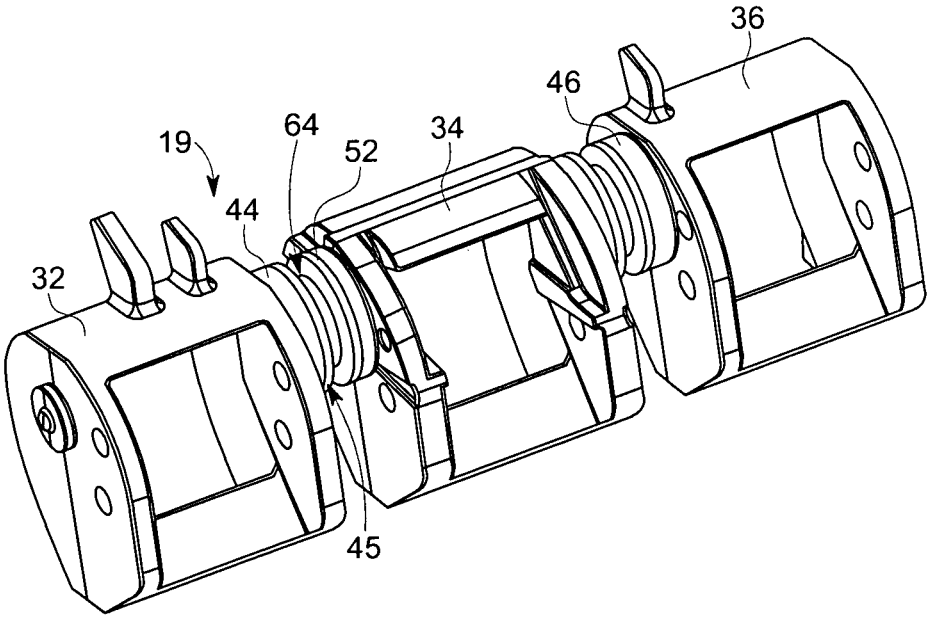
FIG. 3 is a perspective view of the crossbar and a bushing of the support assembly.
Figure 7:
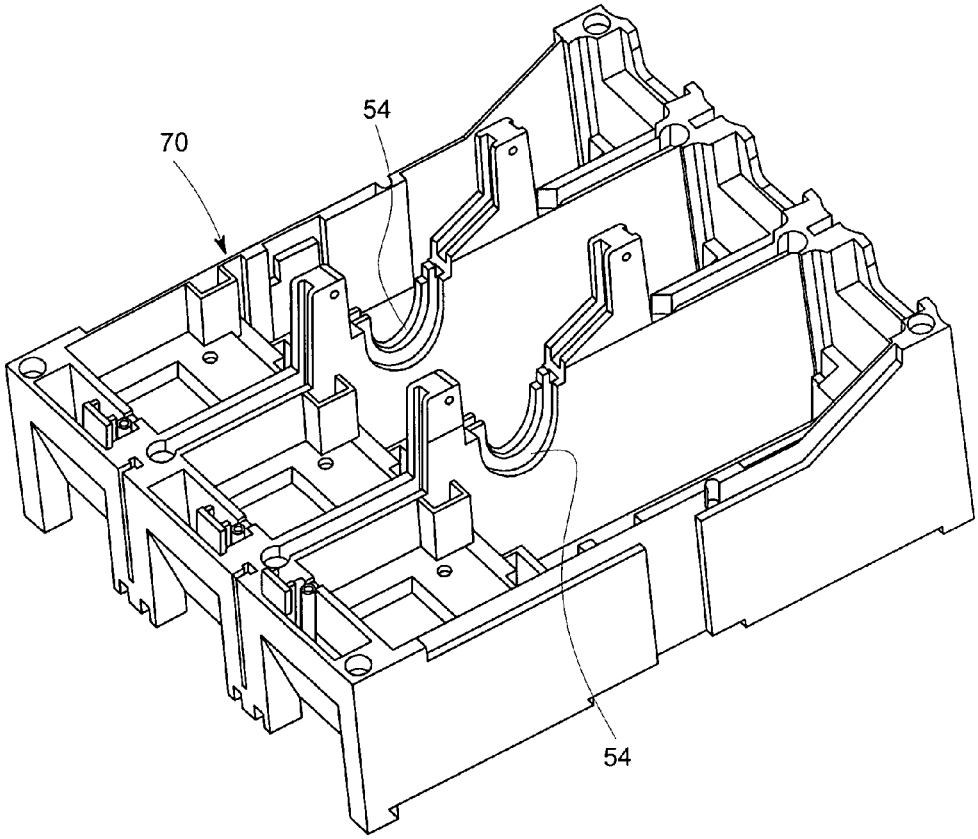
FIG. 7 is a perspective view of a base structure of the circuit breaker with the support bracket operatively coupled thereto.
Figure 8:
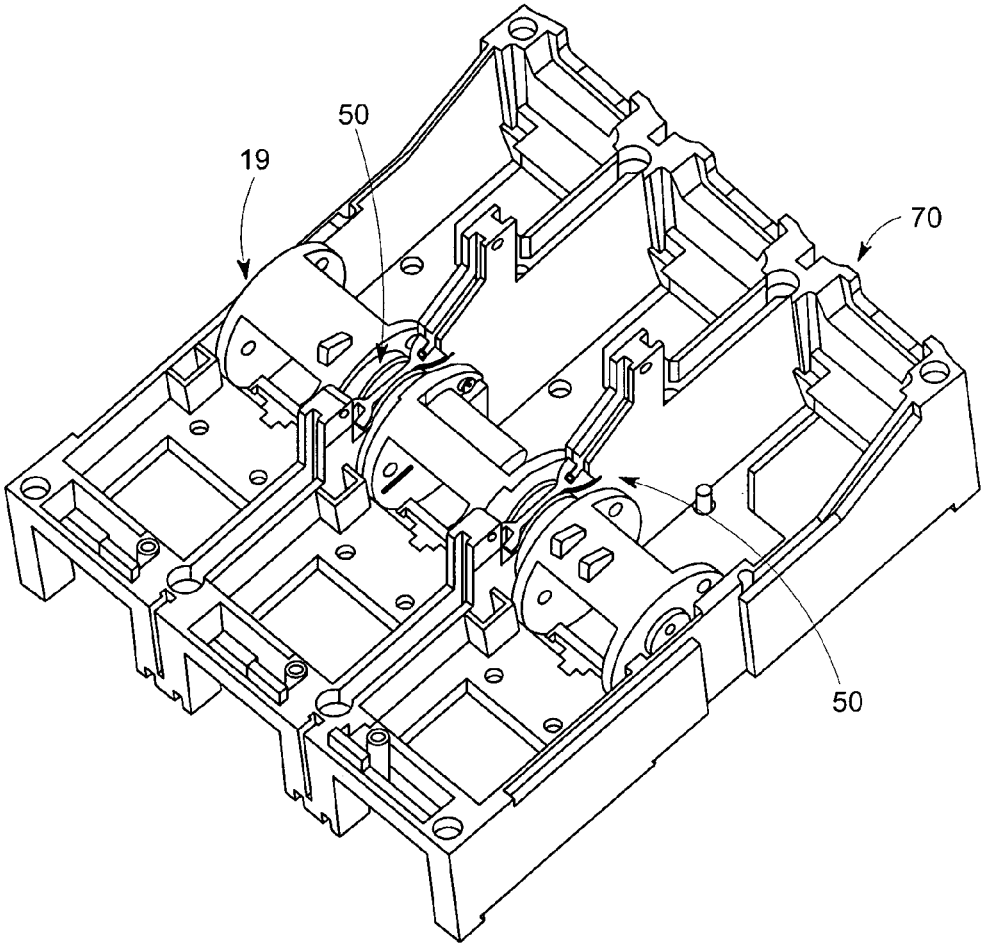
FIG. 8 is a perspective view of the crossbar assembly with the support assembly in a fully assembled and installed condition with the base structure.

Referring now to FIGS. 2 and 3, the crossbar 19 is illustrated in greater detail and without the moveable contact arm assemblies operatively coupled thereto. To reduce or eliminate bending of the crossbar 19 during operation, a support assembly 50 is provided. The support assembly 50 is operatively coupled to one or more coupling segments of the crossbar 19 and to a stationary structure, as illustrated in FIGS. 7 and 8. As will be appreciated from the description herein, the support assembly 50 provides a secure pivoting location for the crossbar 19, thereby strengthening the overall crossbar assembly 18 and reducing wear that may otherwise occur due to bending of the crossbar 19. The support assembly 50 includes a bushing 52, a support bracket 54 and a fixing bracket 56. Each of these components will be described in detail below.

For purposes of discussion a single support assembly associated with the first coupling segment 44 will be described herein; however, as shown and as one can appreciate, more than one support assembly may be operatively coupled to the crossbar 19. By way of example, a first support assembly and a second support assembly are shown in the illustrated embodiment. The first support assembly is operatively coupled to the first coupling segment 44 of the crossbar 19 and the second support assembly is operatively coupled to the second coupling segment 46 of the crossbar 19. As discussed in detail above, the number of segments of the crossbar 19 and therefore the number of coupling segments may vary from that illustrated. There may be as little as one coupling segment or several coupling segments depending upon the particular application. Different embodiments include different numbers of support assemblies as well. For example, all of the coupling segments may include a support assembly operatively coupled thereto.

Alternatively, fewer than all of the coupling segments may include a support assembly operatively coupled thereto.

Figure 4:
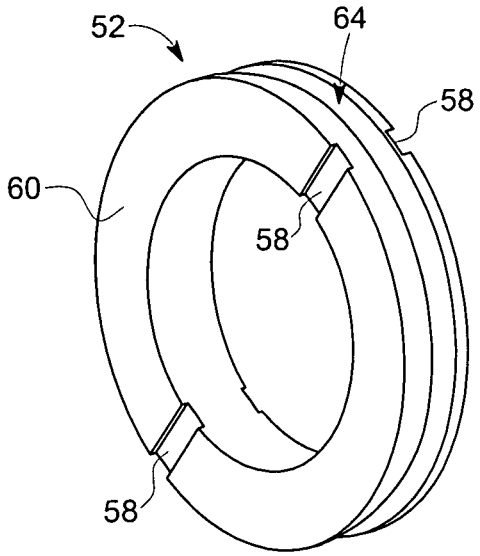
FIG. 4 is a perspective view of the bushing according to an embodiment.
Figure 5:
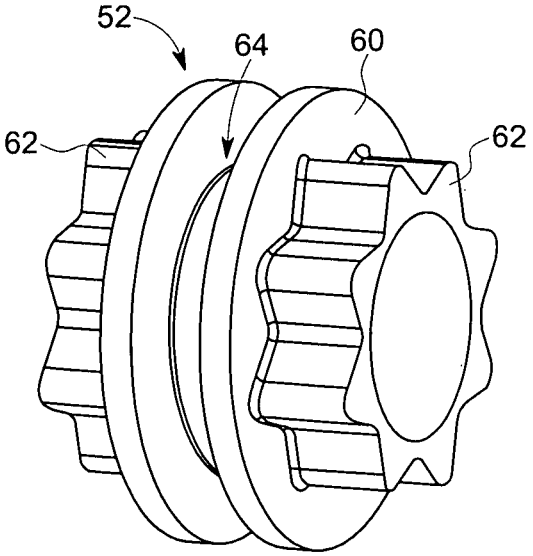
FIG. 5 is a perspective view of the bushing according to another embodiment.

Referring now to FIG. 3, the crossbar 19 is shown with only the bushing 52 of the support assembly 50 operatively coupled thereto. The bushing 52 is formed of a low friction material and may be secured to the first coupling segment 44 in numerous suitable manners. For example, the bushing 52 may be an over-molded component, may be welded to the first coupling segment 44, or may be secured via mechanical fasteners. Irrespective of the precise manner in which the bushing 52 is secured to the first coupling segment 44, a tight, fitted relationship is established between the bushing 52 and the first coupling segment 44. To facilitate this relationship, features may be included to form a rigid connection. For example, the embodiment of FIG. 4 shows at least one groove or recess 58 in an outer face 60 of the bushing 52. The groove or recess 58 is sized to engage one or more protrusions of the crossbar 19 that reside therein to reduce slippage between the bushing 52 and the first coupling segment 44. Alternatively, or in combination with the grooves or recesses described above, one or more protrusions 62 extending from the outer face 60 of the bushing 52 are included in the embodiment of FIG. 5. The bushing 52 may include one or more protrusions on a single side or both sides, as shown. The geometry of the protrusion(s) 62 may vary and corresponds to a recess defined by the crossbar 19. Engagement of the features discussed above establishes a tight, fitted relationship between the bushing 52 and the crossbar 19. In some embodiments, the first coupling segment 44 includes a coupling segment groove 45 that is sized to at least partially fit the bushing 52 therein for further retention between the components.

The bushing 52 includes a groove 64 that extends circumferentially around the bushing 52. The groove 64 is sized to receive engagement portions of the support bracket 54 and the fixing bracket 56 therein. The brackets are relatively stationary and the bushing 52 is configured to rotate relative to these components during rotation of the crossbar 19, as the bushing 52 is fixed thereto and rotates with the crossbar 19. In one embodiment, a ball bearing arrangement is disposed between the bushing 52 and one or both of the brackets to reduce friction therebetween during rotation of the bushing 52.

Figure 6:
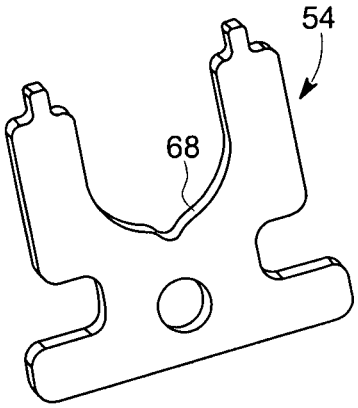
FIG. 6 is a perspective view of a support bracket of the support assembly.

Referring now to FIGS. 6 and 7, the support bracket 54 is illustrated in greater detail. The support bracket 54 includes an engagement portion 68 that extends in a curved manner correspond to the bushing 52 that it is disposed adjacent to. It is to be appreciated that the bushing 52 and the support bracket 54 are in direct contact in some embodiments. In such embodiments, slight spacing may occur during operation of the circuit breaker due to dynamic tolerances. The support bracket 54 is operatively coupled to a stationary structure 70 in any suitable manner that rigidly fixes the support bracket 54 thereto. In the illustrated embodiment, the stationary structure 70 is a base structure of the circuit breaker, but it is to be appreciated that the stationary structure 70 may be a circuit breaker cover that is located over a base structure in some embodiments. For example, a mid-cover may be the stationary structure 70 that the support bracket 54 is operatively coupled to, but any cover is contemplated. The support bracket 54 is substantially stationary due to the rigid connection to the stationary structure 70 and provides a secure support structure for the bushing 52 to be positioned upon. Consequently, the support bracket 54 indirectly supports the crossbar 19 at one or more coupling segments of the crossbar 19, thereby providing a secure point of rotation for the crossbar 19. As described above, this may be done at more than one location along the length of the crossbar 19.

Referring to FIGS. 2 and 8, the support assembly 50 is shown in a fully assembled condition. This condition includes positioning of the fixing bracket 56 disposed adjacent to the bushing 52 and engaged with the support bracket 54. As with the support bracket 54, the fixing bracket 56 includes an engagement portion 72 that extends in a curved manner correspond to the bushing 52 that it is disposed adjacent to. It is to be appreciated that the bushing 52 and the fixing bracket 56 are in direct contact in some embodiments. In such embodiments, slight spacing may occur during operation of the circuit breaker due to dynamic tolerances. The fixing bracket 56 is operatively coupled to the support bracket 54 in any suitable manner and when coupled form a structure that fully surrounds a portion of the bushing 52, specifically the groove 64 of the bushing 52 that the brackets are disposed within.

Advantageously, the support assembly 50 provides a secure support structure for the crossbar 19 to reduce or eliminate bending of the crossbar 19, thereby reducing wear on the crossbar 19. Additionally, less energy is lost due to friction and bending, which results in more available energy from the mechanism to open and close the circuit breaker.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A circuit breaker crossbar assembly comprising:

a crossbar having a first segment and a second segment, the first segment and the second segment each operatively coupled to a respective moveable contact arm assembly;

a coupling segment disposed between the first segment and the second segment, the crossbar and the coupling segment rotatable about an axis; and at least one support assembly operatively coupled to the coupling segment, the at least one support assembly comprising:

a bushing coupled to the coupling segment and rotatable with the crossbar and the coupling segment;

a support bracket configured for affixation to a stationary structure and disposed adjacent to the bushing, the bushing rotatable relative to the support bracket; and a fixing bracket engaged with the support bracket and disposed adjacent to the bushing, the bushing rotatable relative to the fixing bracket, the support bracket and the fixing bracket together at least partially surrounding the bushing.

2. The circuit breaker crossbar assembly of claim 1, wherein the stationary structure that the support bracket is configured for affixation to comprises a base structure.

3. The circuit breaker crossbar assembly of claim 1, wherein the stationary structure that the support bracket is fixed to comprises a cover located over a base structure.

4. The circuit breaker crossbar assembly of claim 1, wherein the coupling segment comprises a coupling segment groove, the bushing at least partially disposed within the coupling segment groove.

5. The circuit breaker crossbar assembly of claim 1, wherein the bushing comprises a bushing groove, the support bracket and the fixing bracket each comprising an engagement portion disposed within the bushing groove.

6. The circuit breaker crossbar assembly of claim 1, wherein the bushing comprises at least one protrusion extending from the bushing, the at least one protrusion fixedly disposed within a recess of the coupling segment, the recess formed of a geometry corresponding to the geometry of the at least one protrusion.

7. The circuit breaker crossbar assembly of claim 1, wherein the crossbar comprises at least three segments each operatively coupled to a moveable contact arm assembly, the circuit breaker crossbar assembly further comprises a plurality of coupling segments, each of the plurality of coupling segments disposed between an adjacent pair of segments of the at least three segments.

8. The circuit breaker crossbar assembly of claim 7, wherein the at least one support assembly comprises a single support assembly operatively coupled to one of the plurality of coupling segments.

9. The circuit breaker crossbar assembly of claim 7, wherein the at least one support assembly comprises a plurality of support assemblies, each of the plurality of coupling segments operatively coupled to one of the plurality of support assemblies.

10. The circuit breaker crossbar assembly of claim 7, wherein the at least one support assembly comprises a plurality of support assemblies, less than all of the plurality of coupling segments operatively coupled to one of the plurality of support assemblies.

11. The circuit breaker crossbar assembly of claim 1, further comprising a ball bearing arrangement disposed between the bushing and the support bracket.

12. A circuit breaker crossbar assembly comprising:

a crossbar having a first segment, a second segment and a third segment, each segment operatively coupled to a respective moveable contact arm assembly;

a first coupling segment disposed between the first segment and the second segment;

a second coupling segment disposed between the second segment and the third segment, the crossbar, the first coupling segment and the second coupling segment rotatable about an axis;

a first support assembly operatively coupled to the first coupling segment and comprising:

a first bushing coupled to the first coupling segment, the first bushing having a protrusion extending therefrom into a first coupling segment recess, the first bushing including a first circumferentially extending groove;

a first support bracket configured for affixation to a stationary structure and disposed in the first circumferentially extending groove of the first bushing to be disposed adjacent to the first bushing, the first bushing rotatable relative to the first support bracket; and a first fixing bracket engaged with the first support bracket and disposed in the first circumferentially extending groove to be disposed adjacent to the first bushing, the first bushing rotatable relative to the first fixing bracket, the first support bracket and the first fixing bracket together at least partially surrounding the first bushing;

a second support assembly operatively coupled to the second coupling segment and comprising:

a second bushing coupled to the second coupling segment, the second bushing having a protrusion extending therefrom into a second coupling segment recess, the second bushing including a second circumferentially extending groove;

a second support bracket configured for affixation to the stationary structure and disposed in the second circumferentially extending groove of the second bushing to be disposed adjacent to the second bushing, the second bushing rotatable relative to the second support bracket; and a second fixing bracket engaged with the second support bracket and disposed in the second circumferentially extending groove to be disposed adjacent to the second bushing, the second bushing rotatable relative to the second fixing bracket, the second support bracket and the second fixing bracket together at least partially surrounding the second bushing.

13. The circuit breaker crossbar assembly of claim 12, wherein the stationary structure that the first support bracket and the second support bracket are configured for affixation to comprises a base structure.

14. The circuit breaker crossbar assembly of claim 12, wherein the stationary structure that the first support bracket and the second support bracket are configured for affixation to comprises a cover located over a base structure.

15. The circuit breaker crossbar assembly of claim 12, wherein the first coupling segment comprises a first coupling segment groove, the first bushing at least partially disposed within the first coupling segment groove, the second coupling segment comprising a second coupling segment groove, the second bushing at least partially disposed within the second coupling segment groove.

16. The circuit breaker crossbar assembly of claim 12, further comprising:

a first ball bearing arrangement disposed between the first bushing and the first support bracket; and a second ball bearing arrangement disposed between the second bushing and the second support bracket.

17. A circuit breaker comprising:

at least one moveable contact arm assembly configured to conduct current through the circuit breaker;

a mechanism configured to actuate movement of the at least one moveable contact arm assembly;

a crossbar having at least one segment, the crossbar rotatable between a first rotational position and a second rotational position and operatively coupled to the mechanism and to the at least one moveable contact arm assembly to rotate the at least one moveable contact arm assembly;

a coupling segment disposed adjacent to the at least one segment, the crossbar and the coupling segment rotatable about an axis; and at least one support assembly operatively coupled to the coupling segment, the at least one support assembly comprising:

a bushing coupled to the coupling segment and rotatable with the crossbar and the coupling segment;

a support bracket configured for affixation to a stationary structure and disposed adjacent to the bushing, the bushing rotatable relative to the support bracket; and a fixing bracket engaged with the support bracket and disposed adjacent to the bushing, the bushing rotatable relative to the fixing bracket, the support bracket and the fixing bracket together at least partially surrounding the bushing.

18. The circuit breaker of claim 17, wherein the stationary structure that the support bracket is fixed to comprises a base structure.

19. The circuit breaker of claim 17, wherein the stationary structure that the support bracket is fixed to comprises a cover located over a base structure.

20. The circuit breaker of claim 17, wherein the coupling segment comprises a coupling segment groove, the bushing at least partially disposed within the coupling segment groove, the bushing comprising a bushing groove, the support bracket and the fixing bracket each comprising an engagement portion disposed within the bushing groove.

* * * * *